US009492916B2

(12) United States Patent
Snyder et al.

(10) Patent No.: US 9,492,916 B2
(45) Date of Patent: Nov. 15, 2016

(54) LOCKING MECHANISM FOR A PUSH BUTTON ACTIVATED FOLDING TOOL

(75) Inventors: Douglas S. Snyder, Littleton, CO (US); Tom D. Koenig, Lakewood, CO (US)

(73) Assignee: Spyderco, Inc., Golden, CO (US)

( * ) Notice: Subject to any disclaimer, the term of this patent is extended or adjusted under 35 U.S.C. 154(b) by 1082 days.

(21) Appl. No.: 13/460,370

(22) Filed: Apr. 30, 2012

(65) Prior Publication Data

US 2013/0283621 A1 Oct. 31, 2013

(51) Int. Cl.
*B26B 1/04* (2006.01)
*B25G 1/08* (2006.01)

(52) U.S. Cl.
CPC ..... *B25G 1/08* (2013.01); *B26B 1/046* (2013.01)

(58) Field of Classification Search
CPC ..... B26B 1/046; B26B 1/044; B26B 1/048; B26B 1/04; B25G 1/08
USPC ..... 30/161, 160, 158, 159; 7/158, 188
See application file for complete search history.

(56) References Cited

U.S. PATENT DOCUMENTS

| | | | | |
|---|---|---|---|---|
| 492,084 | A * | 2/1893 | Brigham | 30/159 |
| 552,077 | A | 12/1895 | Wagner | |
| 557,818 | A | 4/1896 | Hotchkiss | |
| 589,737 | A | 9/1897 | Miller | |
| 589,738 | A | 9/1897 | Miller | |
| 600,442 | A | 3/1898 | Nell | |
| 698,080 | A * | 4/1902 | Treas | 30/159 |
| 736,525 | A | 8/1903 | Kaufmann | |
| 749,230 | A | 1/1904 | Severance | |
| 845,130 | A * | 2/1907 | Schrade | 30/159 |
| 988,068 | A | 3/1911 | Beardsley et al. | |
| 1,030,058 | A | 6/1912 | Doles | |
| 1,194,503 | A | 8/1916 | Jawoisch | |
| 1,362,142 | A | 12/1920 | Rohrer | |
| 1,614,949 | A | 1/1927 | Finley | |
| 1,803,899 | A | 5/1931 | Fuller | |
| 1,864,011 | A | 6/1932 | Brown | |
| 1,994,215 | A | 3/1935 | Gaunt | |
| 2,098,678 | A | 11/1937 | Schrade | |
| 2,263,415 | A | 11/1941 | Berg et al. | |
| 2,415,367 | A | 2/1947 | Pavlovic | |
| 2,461,941 | A | 2/1949 | Sutton | |
| 2,481,309 | A | 9/1949 | Gunnarson | |

(Continued)

FOREIGN PATENT DOCUMENTS

| | | |
|---|---|---|
| CA | 1130567 | 8/1982 |
| CN | 1106247 | 4/2003 |

(Continued)

OTHER PUBLICATIONS

U.S. Appl. No. 13/460,401, filed Apr. 30, 2012, Snyder.

(Continued)

*Primary Examiner* — Stephen Choi
*Assistant Examiner* — Evan MacFarlane
(74) *Attorney, Agent, or Firm* — Sheridan Ross P.C.

(57) ABSTRACT

A folding tool with an improved locking mechanism is provided. The locking mechanism includes a biasing member interconnected to a handle of the tool and coupled to an engagement member, which may be a push button. In various embodiments, the biasing member biases the engagement member towards a locked position in which a portion of the engagement member interacts with a tang of an implement to prevent rotation of the implement.

12 Claims, 6 Drawing Sheets

(56) References Cited

U.S. PATENT DOCUMENTS

D166,064 S 3/1952 Blecher
2,630,114 A 3/1953 Hart
2,889,621 A 6/1959 Bassett
3,006,443 A 10/1961 Siler
3,263,329 A 8/1966 Hennessy
D224,388 S 7/1972 Wood
D224,389 S 7/1972 Wood
3,731,961 A 5/1973 Becker
D227,071 S 6/1973 Bernadotte
3,783,509 A 1/1974 Lake
3,871,141 A 3/1975 Bonapace
D237,458 S 11/1975 Laughlin
3,930,309 A 1/1976 Collins
3,942,394 A 3/1976 Juranitch
4,040,181 A 8/1977 Johnson
4,070,011 A 1/1978 Glesser
4,083,110 A 4/1978 Goldin et al.
4,124,939 A 11/1978 Onoue
4,133,106 A 1/1979 Addis
4,170,061 A 10/1979 Henry
D256,427 S 8/1980 Lile
D256,981 S 9/1980 Sakurai
D257,056 S 9/1980 Spivey
4,231,194 A 11/1980 Glesser
D257,612 S 12/1980 Goldin et al.
4,240,201 A 12/1980 Sawby et al.
4,266,591 A 5/1981 F'Geppert
4,272,887 A 6/1981 Poehlmann
4,274,200 A * 6/1981 Coder ..... B26B 1/046 30/161
4,347,665 A 9/1982 Glesser
4,356,631 A * 11/1982 Guth ..... 30/154
4,393,539 A 7/1983 Weissman
4,394,096 A 7/1983 Stevens
4,408,394 A 10/1983 Phelps
4,447,950 A 5/1984 Mizelle
4,451,982 A 6/1984 Collins
D275,448 S 9/1984 Ferraro
4,535,539 A 8/1985 Friedman et al.
D280,427 S 9/1985 Jones
4,604,803 A 8/1986 Sawby
4,640,058 A 2/1987 Glesser
D288,898 S 3/1987 Osterhout
4,696,129 A 9/1987 Roberts
4,697,673 A 10/1987 Omata
4,703,560 A 11/1987 Brooker
4,719,700 A 1/1988 Taylor, Jr.
4,730,393 A 3/1988 Coburn
D296,518 S 7/1988 Sadler
4,759,153 A 7/1988 Cohen
4,776,094 A 10/1988 Glesser
4,778,094 A 10/1988 Fishback
4,805,303 A 2/1989 Gibbs
4,811,486 A 3/1989 Cunningham
4,819,289 A 4/1989 Gibbs
D302,649 S 8/1989 Porsche et al.
D302,650 S 8/1989 Giordano
D302,934 S 8/1989 Finn
D303,210 S 9/1989 Thompson
D304,154 S 10/1989 Osterhout
4,901,439 A 2/1990 Boyd, Jr.
D310,014 S 8/1990 Inman
4,947,551 A 8/1990 Deisch
4,947,552 A 8/1990 Barnes
D310,621 S 9/1990 Thompson
4,974,323 A 12/1990 Cassady
4,985,998 A 1/1991 Howard
D317,037 S 5/1991 Koshiishi
5,044,079 A 9/1991 Gibbs
5,060,379 A 10/1991 Neely
5,060,890 A 10/1991 Utterback et al.
D321,820 S 11/1991 Russell
D324,899 S 3/1992 Thompson
5,093,995 A * 3/1992 Jan ..... 30/161
5,095,624 A 3/1992 Ennis
5,111,581 A 5/1992 Collins
5,131,149 A 7/1992 Thompson et al.
5,153,995 A 10/1992 Opinel
D333,081 S 2/1993 Glesser
D333,251 S 2/1993 Glesser
D333,859 S 3/1993 Meyer
D337,253 S 7/1993 Glesser
D344,006 S 2/1994 Glesser
5,293,690 A 3/1994 Cassady
D347,375 S 5/1994 Sakai
D348,599 S 7/1994 Sakai
5,325,588 A 7/1994 Rogers
D349,837 S 8/1994 Glesser
D353,988 S 1/1995 Glesser
5,379,492 A 1/1995 Glesser
D356,723 S 3/1995 Sakai
5,400,509 A 3/1995 Collins
5,425,175 A 6/1995 Rogers
D363,871 S 11/1995 Coggins
D365,266 S 12/1995 Hasegawa
D366,408 S 1/1996 Sessions et al.
D367,599 S 3/1996 Sakai
5,495,673 A 3/1996 Gardiner et al.
5,495,674 A 3/1996 Taylor, Jr.
5,502,895 A 4/1996 Lemaire
5,511,310 A 4/1996 Sessions et al.
5,515,610 A 5/1996 Levin et al.
5,537,750 A 7/1996 Seber et al.
5,542,139 A 8/1996 Boivin
5,546,662 A 8/1996 Seber et al.
D373,716 S 9/1996 Keys et al.
5,572,793 A 11/1996 Collins et al.
5,580,019 A 12/1996 Glesser
5,581,888 A 12/1996 Lewis
D377,443 S 1/1997 Seber et al.
5,594,966 A 1/1997 Goldman
5,596,808 A 1/1997 Lake et al.
D378,982 S 4/1997 Thompson
5,615,484 A 4/1997 Pittman
D379,294 S 5/1997 Lum
5,628,117 A 5/1997 Glesser
D379,579 S 6/1997 Pohl
D381,060 S 7/1997 Moran
D382,189 S 8/1997 Viele
D382,459 S 8/1997 Khalsa
5,661,908 A 9/1997 Chen
D384,871 S 10/1997 McWillis
D385,173 S 10/1997 McWillis
D386,664 S 11/1997 Glesser
5,685,079 A 11/1997 Brothers et al.
5,689,890 A 11/1997 Glesser
D387,966 S 12/1997 Horn
D388,150 S 12/1997 Glesser
D389,389 S 1/1998 Glesser
D389,718 S 1/1998 Wegner
5,704,129 A 1/1998 Glesser
D391,465 S 3/1998 Glesser
D392,539 S 3/1998 Balolia
5,722,168 A 3/1998 Huang
5,737,841 A 4/1998 McHenry et al.
5,755,035 A 5/1998 Weatherly
5,765,247 A 6/1998 Seber et al.
D396,657 S 8/1998 Nagai et al.
D397,017 S 8/1998 Pardue
D397,020 S 8/1998 Pardue
5,794,346 A 8/1998 Seber et al.
5,799,400 A 9/1998 Glesser
5,822,866 A 10/1998 Pardue
5,826,340 A 10/1998 Hull
D402,178 S 12/1998 Glesser
D402,524 S 12/1998 Glesser
D403,567 S 1/1999 Glesser
D404,990 S 2/1999 Zowada
D405,338 S 2/1999 Balolia
D407,002 S 3/1999 Morton et al.
5,878,500 A 3/1999 Emerson
5,887,347 A 3/1999 Gibbs
D408,706 S 4/1999 Elishewitz
D409,070 S 5/1999 Elishewitz

(56) References Cited

U.S. PATENT DOCUMENTS

D411,431 S 6/1999 Glesser
D411,790 S 7/1999 Glesser
D412,355 S 7/1999 Saetherbo
5,920,935 A 7/1999 Beck
5,953,821 A 9/1999 Mearns
5,964,036 A 10/1999 Centofante
5,983,506 A 11/1999 Glesser
D418,383 S 1/2000 Bradichansky
D421,378 S 3/2000 Glesser
D422,476 S 4/2000 McHenry et al.
D422,477 S 4/2000 Elishewitz
D422,478 S 4/2000 Elishewitz
D422,479 S 4/2000 Pardue
D422,480 S 4/2000 McHenry et al.
D422,669 S 4/2000 Elishewitz
D422,871 S 4/2000 Terzuola
D422,873 S 4/2000 McHenry et al.
D422,877 S 4/2000 Elishewitz
D425,389 S 5/2000 Elishewitz
D425,391 S 5/2000 Bradichansky
D426,132 S 6/2000 Pardue
6,088,861 A 7/2000 Sessions et al.
D428,789 S 8/2000 McHenry et al.
D429,138 S 8/2000 Glesser
6,101,722 A 8/2000 Cheng
6,101,723 A 8/2000 Ford
6,101,724 A 8/2000 Halligan
6,122,829 A 9/2000 McHenry et al.
D431,991 S 10/2000 Elishewitz
D432,386 S 10/2000 Elishewitz
6,125,543 A 10/2000 Jhones
D433,913 S 11/2000 Pardue
D434,631 S 12/2000 Lum
D435,420 S 12/2000 Ayoob
6,154,965 A 12/2000 Sakai
D436,014 S 1/2001 Glesser
6,170,104 B1 1/2001 Seber et al.
D438,442 S 3/2001 Osborne
D438,443 S 3/2001 Keating
6,205,667 B1 3/2001 Glesser
D441,827 S 5/2001 Frank
D442,460 S 5/2001 Glesser
D442,461 S 5/2001 Glesser
D442,841 S 5/2001 Balolia
6,305,085 B1 10/2001 Stallegger et al.
6,308,420 B1 10/2001 Moser
6,314,646 B1 * 11/2001 Schmidt ..... B26B 5/001 30/125
6,338,431 B1 1/2002 Onion
6,360,443 B1 3/2002 Remus
6,363,615 B1 * 4/2002 Moser ..... B26B 1/04 30/155
6,370,778 B1 4/2002 Conable
6,378,214 B1 4/2002 Onion
6,397,477 B1 6/2002 Collins
D461,387 S 8/2002 Glesser
6,427,335 B1 8/2002 Ralph
6,430,816 B2 8/2002 Neveux
6,438,848 B1 8/2002 McHenry et al.
D464,551 S 10/2002 Glesser
6,490,797 B1 12/2002 Lake et al.
6,523,265 B2 2/2003 Eickhorn
6,553,672 B2 4/2003 Glesser et al.
D474,669 S 5/2003 Onion
6,574,869 B1 6/2003 McHenry et al.
6,591,505 B2 7/2003 Flavigny
6,618,947 B1 9/2003 Gardiner et al.
6,675,484 B2 1/2004 McHenry et al.
6,701,621 B2 3/2004 Kain et al.
6,725,545 B2 4/2004 Frank
6,732,436 B2 5/2004 Moizis
6,751,868 B2 6/2004 Glesser
D495,940 S 9/2004 Keppel et al.
6,789,323 B2 9/2004 Moizis
6,810,588 B1 * 11/2004 Cheng ..... B26B 1/046 30/153
6,836,967 B1 1/2005 Sakai
6,918,184 B2 7/2005 Glesser
D509,124 S 9/2005 Keppel et al.
6,941,661 B2 9/2005 Frazer
6,959,494 B2 11/2005 Taylor
7,032,315 B1 4/2006 Busse
D520,843 S 5/2006 Voros
7,051,441 B2 5/2006 Carter, III
D523,317 S 6/2006 Ryan et al.
7,059,053 B2 6/2006 Sakai
7,146,736 B1 12/2006 Collins
7,243,430 B1 * 7/2007 Lerch ..... B26B 1/046 30/159
7,249,417 B2 7/2007 Chu
D553,467 S 10/2007 Ryan
7,293,360 B2 11/2007 Steigerwalt et al.
7,305,768 B2 12/2007 Hinderer
7,305,769 B2 12/2007 McHenry et al.
7,313,866 B2 1/2008 Linn et al.
7,340,836 B2 3/2008 Whitemiller et al.
D573,864 S 7/2008 Glesser
7,406,896 B2 8/2008 Rivera
7,409,766 B2 8/2008 Steigerwalt
7,437,822 B2 10/2008 Flagg et al.
D581,240 S 11/2008 Glesser et al.
7,533,466 B2 5/2009 Steigerwalt
7,543,386 B2 6/2009 Sullivan
7,555,839 B2 7/2009 Koelewyn
7,562,454 B2 7/2009 Steigerwalt et al.
7,562,455 B2 7/2009 McHenry et al.
7,627,951 B2 12/2009 Glesser et al.
7,676,931 B2 3/2010 Knight et al.
7,676,932 B2 3/2010 Grice
RE41,259 E 4/2010 McHenry et al.
7,694,421 B2 4/2010 Lin
7,774,940 B2 8/2010 Frank
7,905,023 B2 3/2011 Westerfield
7,918,028 B2 4/2011 Steigerwalt et al.
7,987,601 B2 8/2011 Nakamura
8,042,276 B2 10/2011 Lerch et al.
8,082,671 B2 12/2011 Saegesser
8,261,633 B2 9/2012 Maxey
8,402,663 B2 3/2013 Mchenry et al.
8,468,701 B1 * 6/2013 Perez ..... B26B 1/04 30/161
D686,900 S 7/2013 Ohlrich
8,505,206 B2 8/2013 VanHoy
8,572,851 B2 11/2013 Duey
8,607,460 B1 12/2013 Lerch et al.
8,646,184 B2 2/2014 Westerfield
8,745,878 B2 6/2014 Glesser et al.
2001/0022113 A1 9/2001 Kojima et al.
2001/0023541 A1 * 9/2001 Blanchard ..... B26B 1/046 30/161
2003/0019108 A1 * 1/2003 McHenry et al. ..... 30/161
2004/0154169 A1 8/2004 McCann
2004/0231163 A1 11/2004 Sakai
2004/0244205 A1 12/2004 Linn et al.
2006/0064877 A1 3/2006 Vallotton et al.
2006/0123632 A1 6/2006 Linn et al.
2006/0168817 A1 8/2006 Kao
2006/0168819 A1 * 8/2006 Perreault ..... 30/161
2006/0272158 A1 12/2006 Williams
2007/0169351 A1 7/2007 Steigerwalt
2008/0201953 A1 8/2008 Bremer et al.
2008/0222896 A1 9/2008 Marfione et al.
2008/0289198 A1 11/2008 Kaiser et al.
2009/0056146 A1 3/2009 Duey
2009/0144986 A1 6/2009 Frazer
2009/0183374 A1 7/2009 Kao
2009/0193664 A1 8/2009 Galyean
2009/0223061 A1 9/2009 Seber et al.
2009/0271989 A1 11/2009 VanHoy
2010/0236078 A1 9/2010 Duey
2010/0299934 A1 12/2010 VanHoy
2011/0099817 A1 5/2011 Duey

(56) References Cited

U.S. PATENT DOCUMENTS

| | | | | |
|---|---|---|---|---|
| 2013/0125403 | A1* | 5/2013 | Westerfield | B26B 1/046 30/161 |
| 2013/0233113 | A1 | 9/2013 | Saitoh | |
| 2013/0263455 | A1 | 10/2013 | Collins et al. | |
| 2013/0305541 | A1 | 11/2013 | Koenig | |
| 2014/0047718 | A1 | 2/2014 | Fellows et al. | |
| 2014/0373364 | A1* | 12/2014 | Li | B26B 1/046 30/152 |
| 2015/0128426 | A1 | 5/2015 | Sakai | |

FOREIGN PATENT DOCUMENTS

| | | | | |
|---|---|---|---|---|
| CN | 1328021 | | 7/2007 | |
| CN | 1638925 | | 5/2010 | |
| CN | 101193730 | | 5/2010 | |
| CN | 101687324 | | 11/2012 | |
| CN | 103298589 | | 9/2013 | |
| DE | 3041584 | A1 * | 6/1982 | B24D 15/06 |
| DE | 3217529 | | 1/1983 | |
| DE | 3834295 | | 7/1989 | |
| DE | 20109376 | | 8/2001 | |
| DE | 69821034 | | 11/2004 | |
| EP | 1071546 | | 1/2001 | |
| EP | 2183080 | | 5/2010 | |
| EP | 2663430 | | 11/2013 | |
| FR | 2495-986 | | 6/1982 | |
| FR | 2906750 | | 4/2008 | |
| GB | 189822620 | | 12/1898 | |
| GB | 753590 | | 7/1956 | |
| GB | 2084058 | | 4/1982 | |
| JP | S56-175905 | | 12/1981 | |
| JP | H09-108456 | | 4/1997 | |
| JP | H09-511408 | | 11/1997 | |
| WO | WO9511116 | | 4/1995 | |
| WO | WO 2014/039254 | | 3/2014 | |
| WO | WO 2014/039255 | | 3/2014 | |
| WO | WO 2014/130333 | | 8/2014 | |
| WO | WO 2014/130905 | | 8/2014 | |

OTHER PUBLICATIONS

Notice of Allowance for U.S. Appl. No. 13/460,401, mailed Nov. 17, 2014 7 pages.
Official Action for U.S. Appl. No. 13/460,401, mailed Apr. 24, 2014 8 pages.
U.S. Appl. No. 14/542,076, filed Nov. 14, 2014, Glesser.
"Dear Spyderco Customer" Letter from Spyderco, Inc., Nov. 1, 2006, 2 pages.
"Ironstone", Catalog of Knives and Accessories, Fall/Winter 1995-1996, cover, pp. 6-7 and 10-13.
"K.I.S.S. & P.E.C.K." website pages from www.crkt.com/kiss.html, dated Jun. 2, 2008, 3 pages.
"K.I.S.S. Knife from Columbia River Knife and Tool" website pages from http://vvww.shop.com/K_I_S_S_Knife_from_Columbia_River_Knife_and_Tool-33217878-p!.shtml, dated Jun. 2, 2008, 3 pages.
"Knives and Tools for Modern Man", The Edge Company, date unknown, p. 25.
"Latest Designs from Spyderco", date unknown, pp. 1-2.
"Spyderco 2001 Dealer Catalog", Spyderco, Inc., 2001, Part 1, pp. 1-20.
"Spyderco 2001" Spyderco, Inc. 2001, 2 pages.
"Spyderco 2002" Spyderco, Inc. 2002, 3 pages.
"Spyderco 2007 Dealer Pricing", Spyderco, Inc., 2007, 4 pages.
"Spyderco 2007 Product Guide", Spyderco, Inc., 2007, Part 1, pp. 1-24.
"Spyderco 'CLIPITSTM' Flip Open With One Hand", date unknown, p. 28.
"Spyderco Think About It . . . All God's Critters Have Knives", Spyderco, Inc. 1996, 26 pages.
"Spyderco Y2K Dealer Catalog", Spyderco, Inc., 2000, Part 1, pp. 1-17.
"Spyderco Y2K Dealer Catalog", Spyderco, Inc., 2000, Part 2, pp. 18-36.
"SpyderEdge", Spyderco, Inc., 4th Quarter, 2001, pp. 1-6.
"The Bud K Catalog", Bud K Worldwide, Early Fall 2000, p. 3, front and back cover.
"To Our Valuable Distributors and Dealers" Letter from Spyderco, Inc., Nov. 1, 2006, 4 pages.
"Welcome to the World of Spyderco", Spyderco Brochure, Spyderco, Inc., 1998, 42 pages.
Benchmade Knives, www.benchmade.com website, "Axis", Dec. 9, 2003, 17 pages.
Picture of a C40 Jot Singh Khalsa CLIPIT, date unknown, 1 page.
SOG Knives, Vision, retreived from http://web.archive.org/web/20020127064214/http://www.sogknives.com/vision.htm, Jan. 27, 2002, 1 page.
SOG Knives, X-ray Vision, retrived from http://web.archive.org/web/20011208114647/http://www.sogknives.com/xrayvis.htm, Dec. 8, 2001, 1 page.
SOG Knives, Mini X-Ray Vision, retrieved from http://web.archive.org/web/20011211023306/http://www.sogknives.com/minxrvis.htm, Dec. 11, 2001, 1 page.
SOG Knives, Night Vision, retrieved from http://web.archive.org/web/20011208113219/http://www.sogknives.com/nightvis.htm, Dec. 8, 2001, 1 page.
SOG Knives, Sculptura, retrieved from http://web.archive.org/web/20011211022847/http://www.sogknives.com/sculpt.htm, Dec. 11, 2001, 1 page.
Office Action for U.S. Appl. No. 12/244,151 mailed Feb. 15, 2011, 7 pages.
Office Action for U.S. Appl. No. 12/244,151 mailed Nov. 8, 2011, 8 pages.
Office Action for U.S. Appl. No. 12/244,151 mailed Mar. 28, 2013, 6 pages.
Office Action for U.S. Appl. No. 12/244,151 mailed Oct. 23, 2013, 6 pages.
Notice of Allowance for U.S. Appl. No. 12/244,151 mailed Jan. 22, 2014, 5 pages.
Office Action for U.S. Appl. No. 11/759,103, mailed Jan. 12, 2009, 12 pages.
Notice of Allowance for U.S. Appl. No. 11/759,103, mailed Jul. 28, 2009, 14 pages.
"Spyderco 2001 Dealer Catalog," Spyderco, Inc., 2001, 40 pages, uploaded in 2 parts.
"Spyderco 2007 Product Guide," Spyderco, Inc., 2007, 74 pages, uploaded in 3 parts.
"Spyderco Y2K Dealer Catalog," Spyderco, Inc., 2000, 36 pages, uploaded in 2 parts.
Official Action for U.S. Appl. No. 13/474,396, mailed Aug. 13, 2015, 13 pages.
Final Official Action for U.S. Appl. No. 13/474,396, mailed Oct. 27, 2015, 15 pages.

* cited by examiner

LOCKING MECHANISM FOR A PUSH BUTTON ACTIVATED FOLDING TOOL

FIELD

The present disclosure generally relates to folding tools. More specifically, the present disclosure relates to a folding tool with a locking mechanism in communication with an implement for selectively locking the implement in an open or closed position.

BACKGROUND

Many folding tools utilize a locking mechanism that prevents the implement from opening and/or closing unintentionally. For example, existing locking mechanisms for folding knives include "back locks" and "liner locks". The back lock utilizes a generally metallic member that rides on the back of the blade as the blade rotates between a closed position and an open position. Once the blade is in an open position, the back lock member pivots into place behind a flat portion of the tang of the blade, thereby preventing closure of the blade until the back lock member is manually pivoted out of the way of the blade. The liner lock utilizes a thin, generally metallic liner that springs into place behind a flat portion of the tang of the blade, thereby preventing closure until the liner is manually moved out of the way of the blade. In some situations, the back lock and the liner lock have proven to be unreliable. For example, extended use of the back lock and the liner lock, especially in harsh environments, can result in corrosion and wear issues. An example of a liner lock is discussed in U.S. Pat. No. 8,042,276, which is hereby incorporated by reference in its entirety.

As an alternative to the back lock and the liner lock, some lock mechanisms utilize a push button as a lock. To bias the push button into a locked position, a compression spring is positioned coaxially with the pivot axis between the push button and the handle of the folding knife. The addition of a compression spring increases the number of components associated with the locking mechanism, which increases the likelihood of problems. In addition, to accommodate the lack of space between the push button and the handle, a recess is typically formed in the end of the button to at least partially house the compression spring. The recess formed in the button weakens the lock mechanism as the hollow portion of the button typically interacts with the tang of the blade to lock the rotation of the blade. To further accommodate the compression spring, a recess may be formed in the handle as well. However, a recess formed in the handle cannot extend through the handle because the handle acts as a reacting surface for the compression spring. Thus, the handle encloses the locking mechanism and traps water and/or debris within the critical moving parts of the folding knife, which may include the locking mechanism and the pivot axis of the blade. In many situations, trapped water and/or debris can result in corrosion and interfere with the operation of the knife. This problem is accentuated when the folding knife is exposed to harsh environments, including underwater applications.

Based upon at least the aforementioned problems, there exists a long-felt and unsolved need to provide a folding tool with a strong lock mechanism that reduces the number of components utilized in the locking mechanism and that allows drainage of water and/or removal of debris from the critical moving parts of the tool, including the locking mechanism.

SUMMARY

Embodiments of the locking mechanism disclosed herein can be utilized with any type or form of folding tool or apparatus with a deployable implement or member. For example, embodiments of the locking mechanism disclosed herein can be utilized with multi-tools having various implements including, but not limited to, an awl, a container opener, a driver, a file, a knife, a saw, and scissors. For purposes of illustration and clarity, the embodiments disclosed herein are discussed in relation to a folding knife with a rotatable blade.

Embodiments of the present disclosure generally relate to a folding knife comprising a blade, a handle, and a locking mechanism. In various embodiments, the blade is rotatable about a pivot axis that is generally perpendicular to a plane in which the blade rotates. In these embodiments, at least a rear portion of the blade, generally referred to as a tang, is disposed between a first handle portion and a second handle portion in both an open and closed position. Generally, the tang of the blade is rotatably interconnected to the handle, which is comprised of two opposing scales.

It is an aspect of the present disclosure to provide a folding knife utilizing a push button as a lock. In one embodiment, when the push button is in a locked position, a portion of the push button interacts with a tang of a blade to prevent rotation of the blade. In one embodiment, when the push button is in an unlocked or depressed position, a notch formed in the button is configured to allow the tang of the blade to pass through the notch during rotation of the blade.

It is another aspect of the present disclosure to provide a folding knife having a locking mechanism biased toward a locked position. In one embodiment, the locking mechanism comprises a push button coupled to a biasing member. In various embodiments, the biasing member biases the push button towards a locked position in which a portion of the button prevents rotation of a blade of the folding knife. In these embodiments, by depressing the push button, a user can release the lock mechanism to selectively allow rotation of the blade. Further, the biasing member may provide a linear and/or non-linear biasing force.

It is a further aspect of the present disclosure to provide a folding knife with a stronger lock mechanism than existing lock mechanisms. In one embodiment, a push button is coupled to a biasing member, and the biasing member biases the push button towards a locked position in which a portion of the button prevents rotation of a blade of the folding knife. In various embodiments, the biasing member interacts with a sidewall of the button to bias the button. For example, in one embodiment, a free end of the biasing member contacts the sidewall to bias the push button. In another embodiment, a free end of the biasing member extends into a hole formed in the sidewall to bias the push button. In these embodiments, the push button does not require a recession to house a compression spring, as is required in existing button locks. Thus, in these embodiments, a stronger lock mechanism is provided than in existing button locks.

It is an aspect of the present disclosure to provide a folding knife having a locking mechanism utilizing a laterally displaceable biasing member interconnected to a handle of a folding knife. In one embodiment, a locking mechanism comprises an engagement member and a biasing member.

The engagement member generally interacts with the blade of the folding knife to lock the blade in an open or closed position. In one embodiment, the engagement member comprises a push button. The biasing member generally biases the engagement member outwardly towards a locked position in which a portion of the engagement member locks the folding knife and prevents rotation of the blade. In one embodiment, the biasing member comprises a sidespring. The sidespring, in one embodiment, is integrally interconnected to a handle. For example, in various embodiments, the sidespring may be formed in the handle. In these embodiments, various manufacturing methods can be utilized to form the sidespring, including, but not limited to, molding, cutting, or machining, as known in the art. If formed in the handle, the sidespring and the handle comprise a single component of the folding knife, thus reducing the need for additional components and/or material to interconnect or position the sidespring within the handle. This is advantageous because in certain environments, including marine applications, reducing the number of components that will be exposed to the harsh environment results in a more robust knife with a reduced likelihood of failure. In alternative embodiments, the sidespring can be interconnected to a handle portion using methods known in the art, including, but not limited to, adhesives, fasteners, and welding.

Another aspect of the present disclosure is to provide a lockable folding knife with improved drainage of water and/or removal of debris out of the moving parts of the folding knife. In one embodiment, an aperture is formed in the handle of the folding knife to accommodate an engagement member, which may be a button, operating as a lock. The aperture allows water to drain and/or debris to be removed out of the folding knife, thus reducing factors that lead to corrosion within the critical moving parts of the knife. For example, a handle aperture provides easy drainage of water from within the knife, which, if not drained, can cause corrosion. As another example, a handle aperture provides easy removal of debris trapped within the folding knife, which, if not removed, can affect the operation of the knife, particularly the rotation of the blade and the displacement of the locking mechanism. Existing button lock folding knifes do not utilize an aperture in the handle of the folding knife because a compression spring housed within the folding knife requires the handle to have a solid surface for the compression spring to properly bias the button into a locked position.

The embodiments discussed herein can be modified to be used in association with any folding tool or apparatus with a rotatable implement or member. The embodiments discussed herein also can be modified to be used in association with any folding knife with a rotatable blade. For example, embodiments of the present disclosure can be utilized with automatic knives, spring-assisted knives, and manual opening folding knives. Similarly, embodiments of the present disclosure may be adapted for use with any type of handle. For example, as used herein, a 'handle portion' can refer to a scale, a liner, a spacer, or any combinations thereof. The terms first and second are not intended to connote importance or priority, but are used to distinguish one component from another. Embodiments of knives discussed herein may be constructed of any materials now known or later developed in the art, including, but not limited to, aluminum, steel, stainless steel, and various forms of plastics.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the claimed subject matter is intended by either the inclusion or non-inclusion of elements, components, etc. in this Summary. Moreover, reference made herein to "the present invention" or aspects thereof should be understood to mean certain embodiments of the present disclosure and should not necessarily be construed as limiting all embodiments to a particular description.

BRIEF DESCRIPTION OF THE DRAWINGS

The accompanying drawings, which are incorporated in and constitute a part of the specification, illustrate embodiments of the disclosure and together with the general description given above and the detailed description of the drawings given below, serve to explain the principles of these embodiments.

Figure 1:
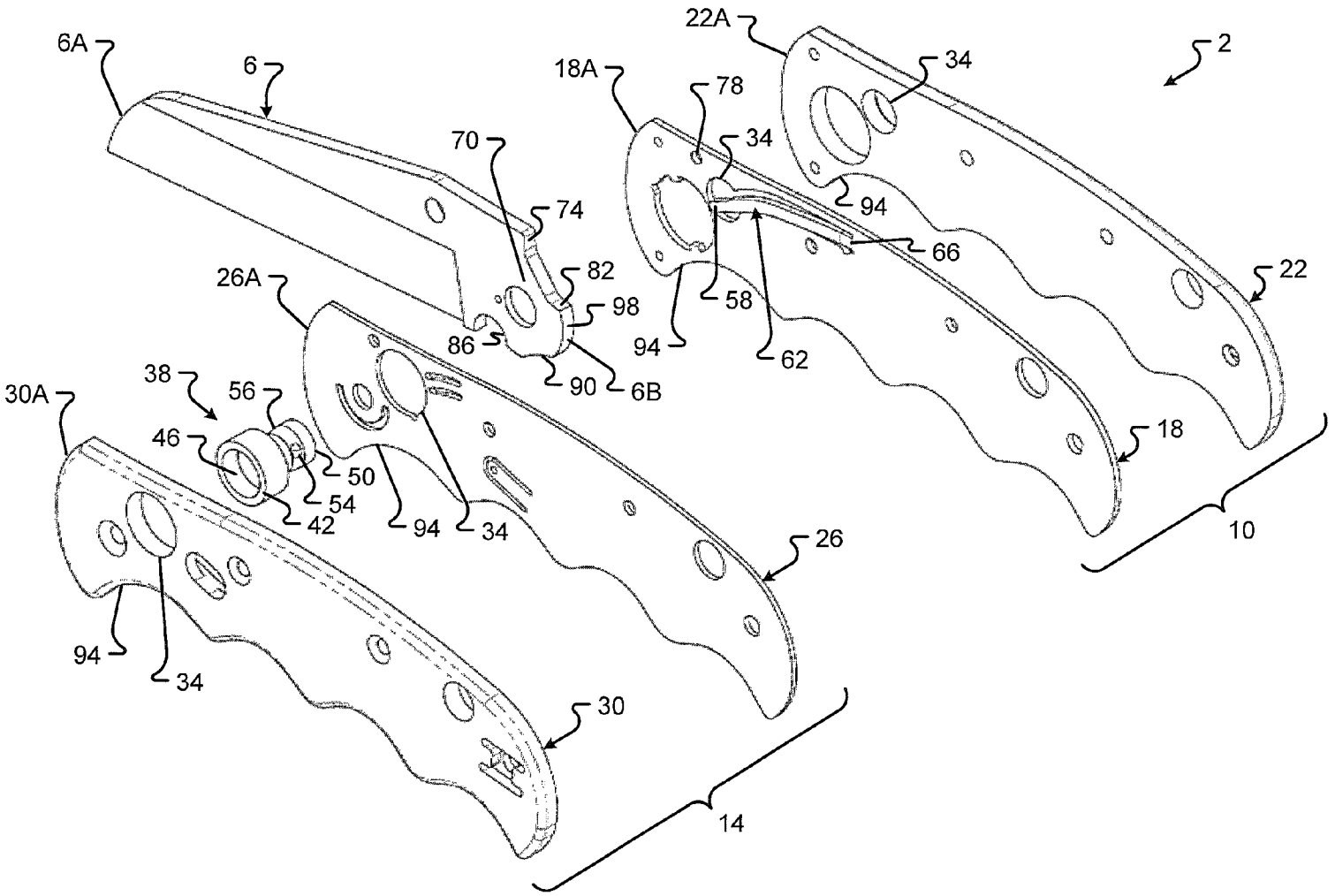
FIG. 1 is an exploded front perspective view of an embodiment of a folding knife in an open position.

It should be understood that the drawings are not necessarily to scale. In certain instances, details that are not necessary for an understanding of the disclosure or that render other details difficult to perceive may have been omitted. It should be understood, of course, that the claimed invention is not necessarily limited to the particular embodiments illustrated herein.

To assist in the understanding of the drawings, the following is a list of components and associated numbering found in the drawings:

| # | Components |
|---|---|
| 2 | Folding knife |
| 6 | Blade |
| 6A | Front end of blade |
| 6B | Rear end of blade |
| 10 | First handle portion |
| 14 | Second handle portion |
| 18 | First liner |
| 18A | Forward portion of first liner |
| 22 | First scale |
| 22A | Forward portion of first scale |
| 26 | Second liner |
| 26A | Forward portion of second liner |
| 30 | Second scale |
| 30A | Forward portion of second scale |
| 34 | Aperture |
| 38 | Push button (or, alternatively, engagement member) |
| 42 | First end of push button or engagement member |
| 46 | Recessed portion |
| 50 | Second end of push button or engagement member |
| 54 | Receiving hole |
| 56 | Sidewall |
| 58 | Free end (or, alternatively, second end) |
| 62 | Biasing member |
| 66 | Fixed end (or, alternatively, first end) |
| 70 | Tang |
| 74 | Stop pin contact surface |
| 78 | Stop pin aperture |
| 82 | Open position button contact surface |
| 86 | Closed position button contact surface |
| 90 | Concave surface |
| 94 | Contoured grip |
| 98 | Convex surface |
| 106 | Notch |
| 114 | Predetermined width |
| 118 | Alignment surface |
| 122 | Liner |
| 122A | First end of liner |
| 122B | Second end of liner |
| 126 | First cylindrical portion of sidewall |
| 130 | Second cylindrical portion of sidewall |
| 134 | Ramp portion of sidewall |
| 138 | Third cylindrical portion of sidewall |

DETAILED DESCRIPTION

With reference to FIG. 1, an exploded perspective view of one embodiment of a locking folding knife 2 in an open position is provided. In this embodiment, the folding knife 2 comprises a blade 6 and a handle. The blade 6 is positioned between a first handle portion 10 and a second handle portion 14. The first handle portion 10 comprises a first liner 18 and a first scale 22, and the second handle portion 14 comprises a second liner 26 and a second scale 30. In the depicted embodiment, an aperture 34 extends through the handle, including the first handle portion 10 and the second handle portion 14, and is configured to accommodate a push button 38.

The push button 38 shown in FIG. 1 includes a first end 42 having a recessed portion 46 and a second end 50 having no recessed portion. The recessed portion 46 provides a means for a user to locate and index the button 38 and reduces the weight of the folding knife 2. The lack of a recessed portion in a second end 50 of the button 38 increases the strength of the button 38 and thus provides a stronger lock mechanism. In the embodiment of FIG. 1, the button 38 also includes a receiving hole 54 formed in a sidewall 56 of the button 38. The receiving hole 54 is configured to receive a free end 58 of a biasing member 62, which is interconnected to the first liner 18.

The biasing member 62 of FIG. 1 is integrally formed in the first liner 18. In the depicted embodiment, the biasing member 62 is an extension of the first liner 18. The biasing member 62 has a fixed end 66 that is integrally connected to the first liner 18, and a free end 58 that is laterally-displaceable relative to the fixed end 66 and to the first liner 18. The biasing member 62 biases the push button 38 towards a locked position in which a portion of the push button 38 interacts with a tang 70 of the blade 6 to prevent rotation of the blade 6. Although the illustrated embodiment depicts the biasing member 62 as being integrally formed in the first liner 18, it should be appreciated that in alternative embodiments the biasing member 62 can be a separate member interconnected to the first liner 18 using methods known in the art, including, but not limited to, adhesives, fasteners, and welding. Additionally, it should be appreciated that in alternative embodiments the biasing member 62 can be formed in and/or interconnected to various components of the handle. As can be appreciated, some folding knives do not have liners and the blade is positioned directly between the scales. In these types of folding knives, the biasing member 62 can be interconnected to, which may include being formed in, a scale. It is contemplated that embodiments of the locking mechanism discussed herein can be utilized with any variation of folding knife, including automatic, spring assist, and manual folding knives.

Referring back to the embodiment depicted in FIG. 1, a blade 6 includes a front end 6A and a rear end 6B. The rear end 6B includes a tang 70 configured to be rotatably interconnected to a forward portion 18A, 22A, 26A, 30A of the handle. The tang 70 includes a stop pin contact surface 74 to contact a stop pin, which interconnects to a stop pin aperture 78 formed in the first liner 18, when the blade 6 is in an open position. The stop pin contact surface 74 limits the rotation of the blade 6 and prevents over-rotation of the blade 6 in an open position. The tang 70 also includes an open position button contact surface 82. In an open position with the button 38 in a locked position, a portion of the push button 38 interacts with the contact surface 82 of the tang 70 to prevent rotation of the blade 6 towards a closed position. The tang 70 further includes a closed position button contact surface 86. In a closed position with the button 38 in a locked position, a portion of the push button 38 interacts with the contact surface 86 of the tang 70 to prevent rotation of the blade 6 towards an open position. Moreover, the tang 70 includes a concave surface 90 that matches the contoured grip 94 of the handle when the blade is in an open position, and a convex surface 98.

A method of assembling a locking mechanism of a folding knife 2 having a blade 6 and a handle according to an embodiment of the present disclosure is provided as well. In general, a blade 6 is provided that includes a tang 70 on a rear portion 6B, and a handle is provided with a first handle portion 10 and a second handle portion 14. The first handle portion 10 and the second handle portion 14 may include a liner, a scale, or various combinations thereof. In one configuration, the first handle portion 10 includes a liner 18 and a scale 22. In this configuration, a biasing member 62 is interconnected to the liner 18, and may be integrally formed with the liner 18. After interconnection, a laterally-displaceable free end 58 of the biasing member 62 is inserted into a receiving hole 54 formed in a sidewall 56 of a push button 38 to couple the button 38 to the biasing member 62. The button 38 is positioned within an aperture 34 formed in the first handle portion 10 and the second handle portion 14, and the first handle portion 10 and the second handle portion 14 are interconnected. In addition, a tang 70 of the blade 6 is rotatably interconnected to the handle. Although not depicted, various fasteners, pins, spacers, and other components may be utilized in assembling the folding knife 2, as is known in the art.

Figure 2:
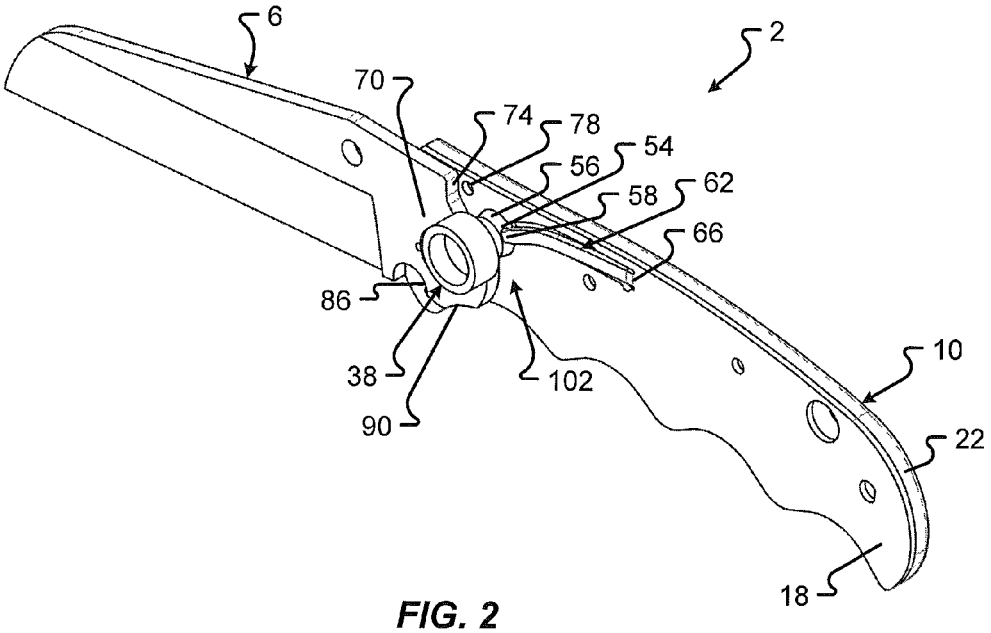
FIG. 2 is a front perspective view of an embodiment of a partially assembled folding knife in an open position.
Figure 3:
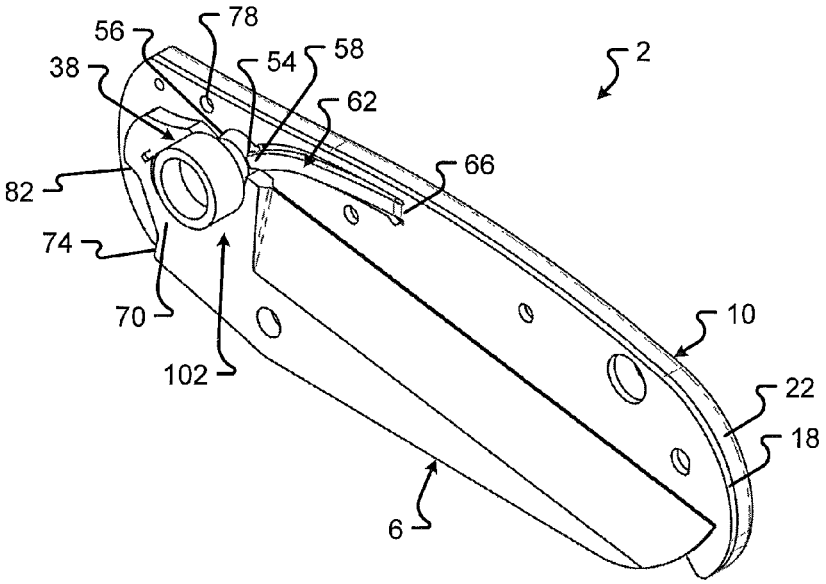
FIG. 3 is a front perspective view of an embodiment of a partially assembled folding knife in a closed position.

Referring now to FIGS. 2-3, a perspective view of an embodiment of a partially assembled folding knife 2 is provided. In the embodiment depicted in FIGS. 2-3, a blade 6 includes a tang 70 rotatably interconnected to a first handle portion 10 such that the blade 6 may be selectively rotated between an open and closed position. A second handle portion 14 has been removed in FIGS. 2-3 to illustrate a locking mechanism 102, which comprises a button 38 coupled to a biasing member 62, that locks the blade 6 in an open or closed position. As illustrated in FIGS. 2-3, a free end 58 of the biasing member 62 extends into a receiving hole 54 formed in a sidewall 56 of the push button 38 to couple the button 38 to the biasing member 62. In alternative embodiments, a push button 38 does not include a receiving hole 54. Rather, the free end 58 of the biasing member 62 contacts the sidewall 56 to couple the button 38 to the biasing member 62. For example, in an alternative embodiment, a sidewall 56 of the push button 38 may include a pair of flanges for the free end 58 to fit between or an annular groove for the free end 58 to reside within. Referring particularly to FIG. 2, the blade 6 is locked in an open position by the button 38 and a stop pin. Although the stop pin is not depicted, the stop pin attaches to the stop pin aperture 78 formed in the first handle portion 10 and contacts the stop pin contact surface 74 of the tang 70 to prevent over-rotation. A sidewall 56 of the button 38 interacts with the open position contact surface 82 of the tang 70 to prevent the blade 6 from being rotated toward a closed position. Referring to FIG. 3, the blade 6 is locked in a closed position by the button 38. A sidewall 56 of the button 38 interacts with the closed position contact surface 86 of the tang 70 to prevent the blade 6 from being rotated toward an open position.

Figure 4:
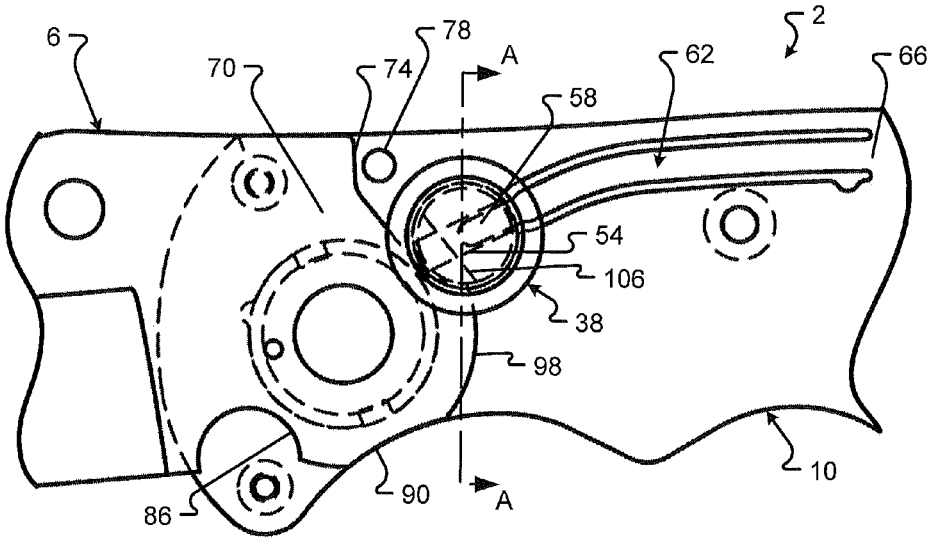
FIG. 4 is a front elevation view of an embodiment of a partially fragmented folding knife in an open position.
Figure 6:
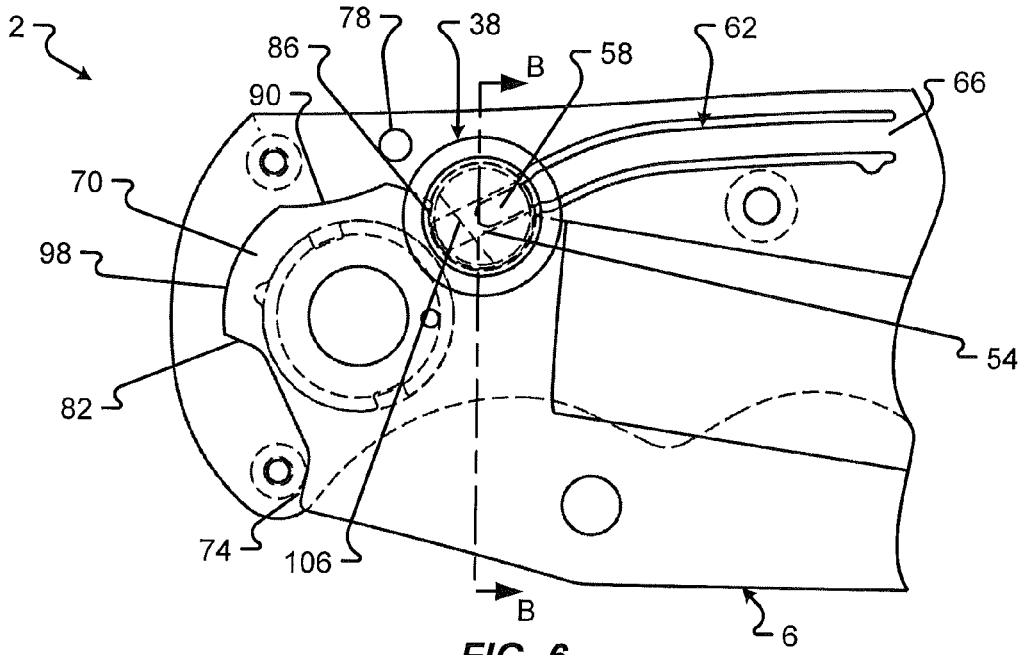
FIG. 6 is a front elevation view of an embodiment of a partially fragmented folding knife in a closed position.

Referring to FIGS. 4 and 6, a front elevation view of an embodiment of a partially fragmented folding knife 2 in an open position and closed position, respectively, is depicted. In the embodiment depicted in FIGS. 4 and 6, a biasing member 62 has a fixed end 66 integrally formed in the first handle portion 10 and a free end 58 that extends into a receiving hole 54 formed in a push button 38. The receiving hole 54 is depicted as a through-hole, which advantageously allows water and debris to drain out of the button 38 to reduce corrosion. In an alternative embodiment, however, the receiving hole 54 is not a through-hole and only extends partially into the sidewall 56 of the button 38. In the depicted embodiment, a notch 106 is formed in the button 38 and configured to allow rotation of the blade 6 when the notch 106 is laterally aligned with the tang 70 of the blade 6. As depicted, the notch 106 is configured to allow the convex surface 98 of the tang 70 to rotate through the notch 106 without contacting an inner surface of the notch 106. When the button 38 is in an unlocked position and the blade 6 has been rotated such that the convex surface 98 of the tang 70 has entered the notch 106, the tang 70 holds the button 38 in an unlocked position and prevents the button 38 from locking during blade rotation between the open and closed position.

Figure 5A:
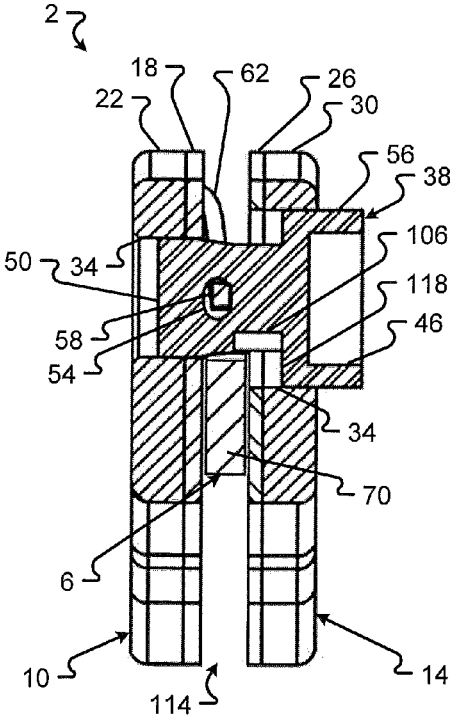
FIG. 5A is a cross-section view taken along line A-A of the folding knife shown in FIG. 4 in a locked position.
Figure 7:
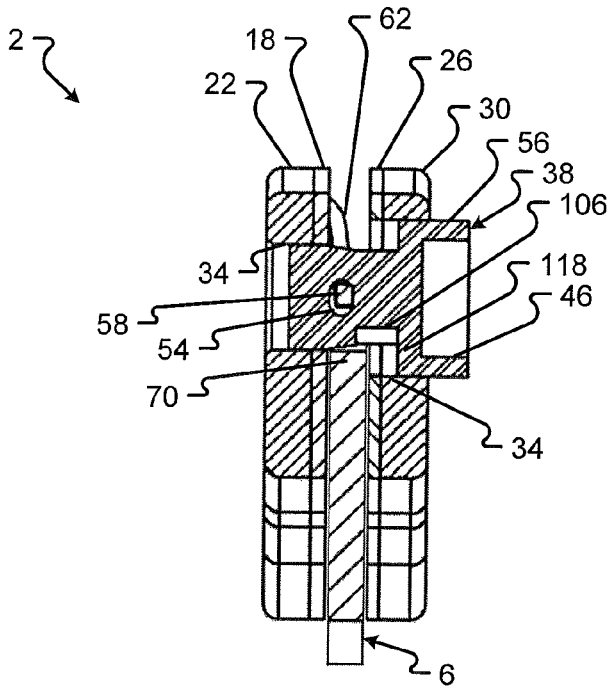
FIG. 7 is a cross-section view taken along line B-B of the folding knife shown in FIG. 6 in a locked position.

Referring now to FIGS. 5A and 7, FIG. 5A is a cross-section view taken along line A-A of the folding knife 2 shown in FIG. 4, and FIG. 7 is a cross-section view taken along line B-B of the folding knife 2 shown in FIG. 6. The depicted embodiments show a handle comprising a first handle portion 10 spaced apart from a second handle portion 14 by a predetermined width 114 that is based upon the width of the blade 6. As depicted, the tang 70 of the blade 6 is disposed between the first handle portion 10 and the second handle portion 14. A push button 38 is positioned within an aperture 34 formed in the first handle portion 10 and the second handle portion 14. The button 38 is coupled to a free end 58 of the biasing member 62, and, as illustrated, the button 38 is in a non-displaced position. In the embodiment depicted in FIG. 5A, the blade 6 is locked in an open position and a sidewall 56 of the button 38 prevents the tang 70 from rotating towards a closed position. In the embodiment depicted in FIG. 7, the blade 6 is locked in a closed position and a sidewall 56 of the button 38 prevents the tang 70 from rotating towards an open position. In both FIGS. 5A and 7, the free end 58 of the biasing member 62 biases the push button 38 towards this locked position. For example, by pushing the button 38 in a direction substantially transverse to the folding knife 2, the free end 58 of the biasing member 62 displaces laterally relative to a fixed end 66 of the biasing member 62 and to the first liner 18. The stiffness of the biasing member 62 resists the lateral displacement, and biases the push button 38 towards the non-displaced position in which a portion of the push button 38 interacts with the tang 70 of the blade 6 to prevent rotation of the blade 6.

Figure 5B:
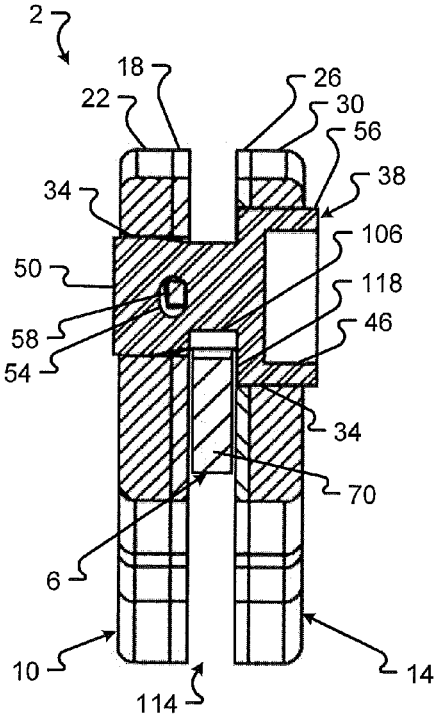
FIG. 5B is a cross-section view taken along line A-A of the folding knife shown in FIG. 4 in an unlocked position.

FIG. 5B is a cross-section view taken along line A-A of the folding knife shown in FIG. 4 in an unlocked position. To unlock the blade 6, a user presses the push button 38 transverse to the folding knife 2 until an alignment surface 118 of the push button 38 abuts the tang 70, at which point the tang 70 of the blade is aligned with a notch 106 formed in the push button 38. The notch 106 is configured to accommodate the tang 70 and to allow the blade 6 to rotate between an open and closed position. Once the blade 6 has been rotated to a position between the open and closed positions, the tang 70 contacts the side surfaces of the notch 106 and prevents lateral displacement of the button 38. Once the blade 6 is rotated into an open or closed position, a biasing force, which may be linear and/or non-linear, of the biasing member 62 laterally displaces the button 38 into a locked position in which a portion of the push button 38 contacts the tang 70 to prevent rotation of the blade 6. As can be appreciated, if the folding knife 2 is an automatic knife, when the notch 106 is aligned with the tang 70 in a closed position, the blade 6 automatically rotates toward an open position. If the folding knife 2 is a non-automatic knife, a user can manually rotate the blade 6 towards an open position when the notch 106 is aligned with the tang 70.

Referring back to the embodiments illustrated in FIGS. 5A and 7, the free end 58 of the biasing member 62 is laterally offset from the liner 18 in a non-displaced position.

In an alternative embodiment, the free end 58 of the biasing member 62 in a non-displaced position is coplanar with the liner 18 with no lateral offset. In this alternative embodiment, the receiving hole 54 is formed closer to the second end 50 of the push button 38 to accommodate the free end 58 of the biasing member 62. The locking mechanism, in this alternative embodiment, operates in the same fashion as described above with the biasing member 62 biasing the push button 38 towards a locked position.

In accordance with an embodiment of the present disclosure, a method of releasing a locking mechanism of a folding knife 2 having a blade 6 and a handle is provided. In this embodiment, the blade 6 generally includes a tang 70 rotatably interconnected to the handle. In various embodiments, to release the locking mechanism, a user pushes a button 38 in a direction substantially transverse to the folding knife 2. The button 38 displaces a free end 58 of a biasing member 62 laterally relative to a fixed end 66 of the biasing member 62. The user depresses the button 38 until a notch 106 formed in the button 38 is laterally aligned with the tang 70. Once aligned, the blade 6 can be rotated. Upon rotation of the blade 6 to an open or closed position, the free end 58 of the biasing member 62 displaces the button 38 into a locked position.

Figure 8:
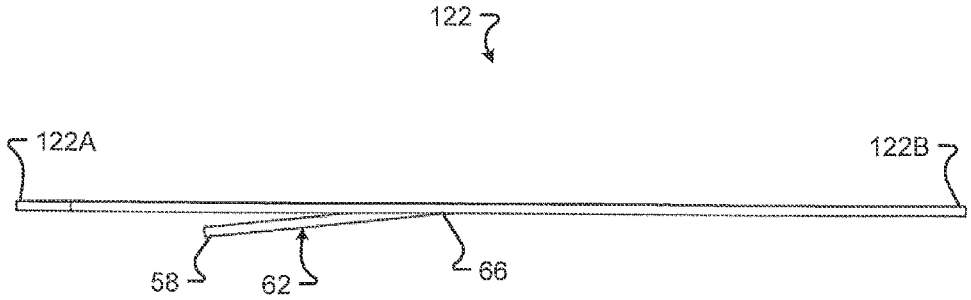
FIG. 8 is a top plan view of an embodiment of a liner.

Referring now to FIG. 8, a top plan view of an embodiment of a liner 122 is provided. The depicted liner 122 is generally planar and extends from a first end 122A to a second end 122B. In the depicted embodiment, a biasing member 62 is interconnected to the liner 122 at a fixed end 66. In various embodiments, the biasing member 62 has a length that is substantially less than the liner 122. As can be appreciated, the length of the biasing member 62 can vary depending on the desired force required to laterally displace a second end 58 of the biasing member 62. In the depicted embodiment, the first end 66 is integrally formed in the liner 122 and is coplanar with the liner 122. In alternative embodiments, the biasing member 62 may be interconnected to the liner 122 using methods known in the art, including, but not limited to, adhesives, fasteners, and welding. As depicted, the biasing member is in a non-displaced position and a second end 58 of the biasing member 62 is laterally offset from the first end 66 and the liner 122. As discussed earlier, in an alternative embodiment, a second end 58 of the biasing member 62 may be coplanar with the liner 122 in a non-displaced position. In this alternative embodiment, a recess can be formed in a scale affixed to an outer surface of the liner 122 to accommodate the lateral displacement of the biasing member 62. In some embodiments, a liner 122 is not utilized. In these embodiments, a biasing member 62 is interconnected to a scale in a similar fashion as described above in connection with the liner 122.

Referring back to the embodiment depicted in FIG. 8, the biasing member 62 has a linear profile between the first end 66 and the second end 58. In alternative embodiments, the biasing member 62 may have an arcuate profile between the first end 66 and the second end 58. The biasing member 62 can provide a linear and/or non-linear biasing force to bias the push button 38 laterally relative to the tang 70 of the blade 6.

Figure 9:
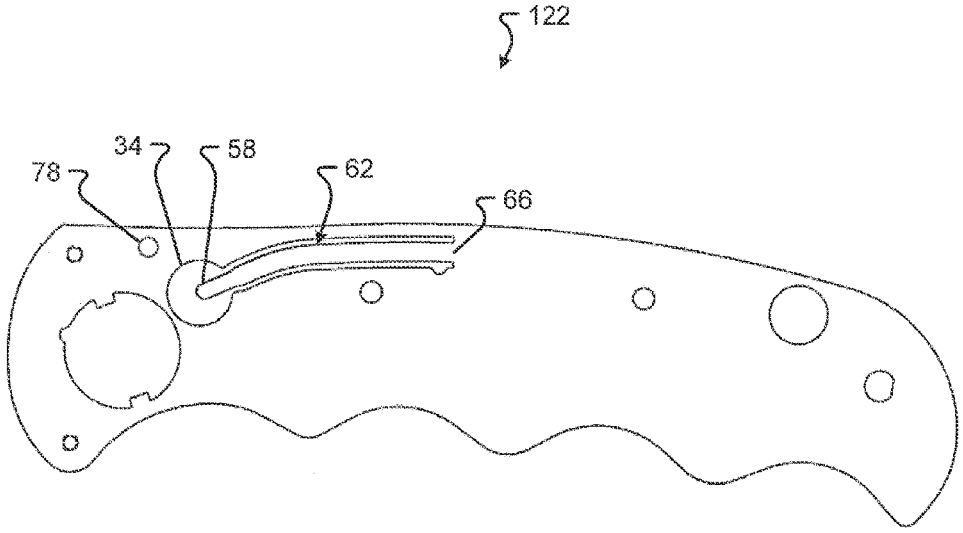
FIG. 9 is a front elevation view of an embodiment of a liner.
Figure 10:
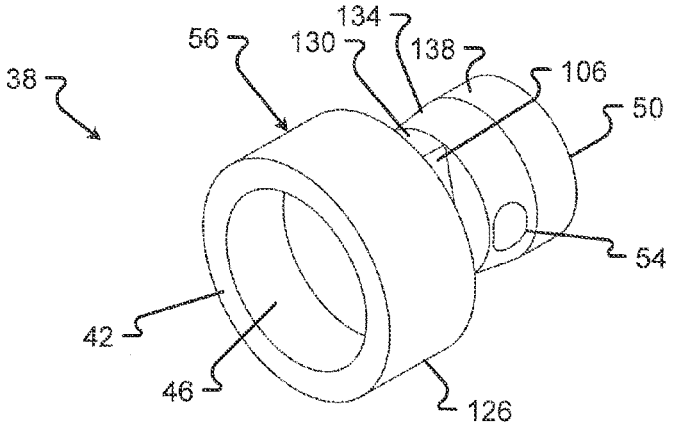
FIG. 10 is a front perspective view of an embodiment of a button.
Figure 11:
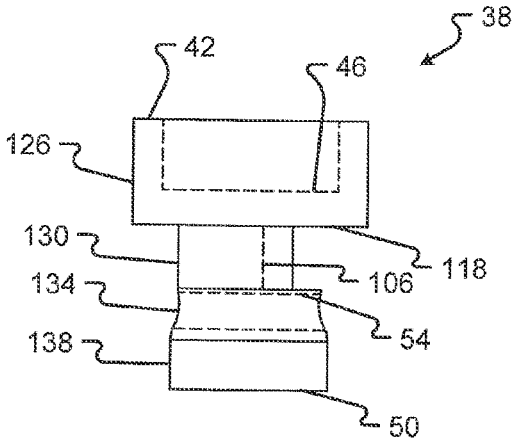
FIG. 11 is a top plan view of the button shown in FIG. 10.
Figure 12:
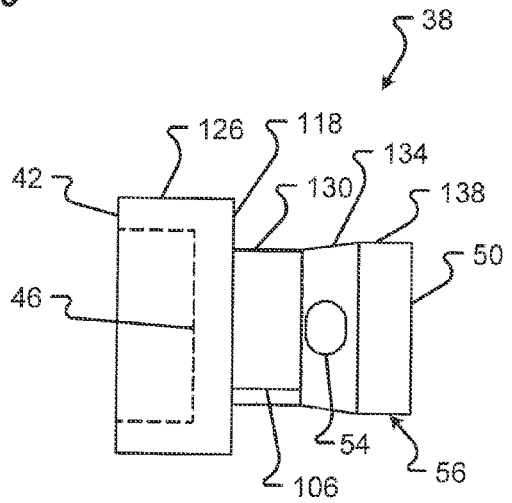
FIG. 12 is a side elevation view of the button shown in FIG. 10.
Figure 13:
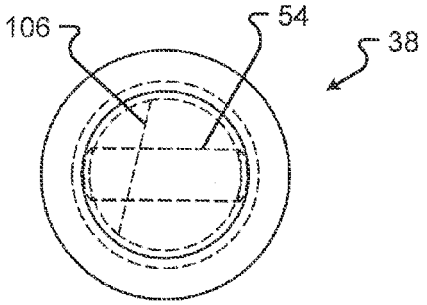
FIG. 13 is a front elevation view of the button shown in FIG. 10.

Referring now to FIG. 9, a front elevation view of an embodiment of a liner 122 is depicted. The biasing member 62 depicted in FIG. 9 is integrally formed, or connected to, the liner 122 at a first end 66. A second end 58 of the biasing member 62 is laterally displaceable relative to the first end 66 of the biasing member 62 in a direction substantially transverse to the liner 122. A button aperture 34 is formed in the liner 122, and is generally associated with a push button 38 that couples to the second end 58 of the biasing member 62. In the depicted embodiment, the biasing member 62 has an arcuate shape, which extends from the first end 66 to the second end 58. As can be appreciated, the shape of the biasing member 62 can vary. Generally, the shape and location of the biasing member 62 allows the biasing member 62 to not interfere with the rotation of the blade 6.

With reference to FIGS. 10-13, one embodiment of a button 38 is provided. The button 38 depicted in FIGS. 10-13 includes a first end 42 with a recess 46 and a second end 50 without a recess. The recess 46 reduces the weight of the button 38 and provides indexing for a user's finger. Between the first end 42 and the second end 50, a sidewall 56 includes a first cylindrical portion 126, a second cylindrical portion 130, a ramp portion 134, and a third cylindrical portion 138. The first cylindrical portion 126 is configured to be disposed at least partially within an aperture 34 formed in a second handle portion 14, and is separated from the second cylindrical portion 130 by an alignment surface 118. A notch 106 is formed in the second cylindrical portion 130 and is configured to allow rotation of a blade 6 when the notch 106 is aligned with a tang 70 of the blade 6. A receiving hole 54 is formed in a ramp portion 134, which may be linear and/or arcuate. In alternative embodiments, the receiving hole 54 may be formed in the third cylindrical portion 138. For example, if the free end 58 of the biasing member 62 is not laterally offset from a fixed end 66 of the biasing member 62, then the receiving hole 54 may be formed in the third cylindrical portion 138. In the depicted embodiments, the receiving hole 54 is a through-hole. However, in alternative embodiments, the receiving hole 54 does not extend through the button 38 and extends a sufficient distance into the button 38 to accommodate a free end 58 of the biasing member 62.

In operation, according to various embodiments, when the button 38 is in a non-displaced position, the ramp portion 134 and/or the third cylindrical portion 138 interacts with the tang 70 of the blade 6 to prevent blade rotation. In a fully depressed position, the alignment surface 118 of the push button 38 abuts the tang 70 of the blade 6. In this position, the notch 106 aligns with the tang 70 and allows rotation of the blade 6. When the blade 6 is rotated between a fully open and a fully closed position, the tang 70 of the blade 6 prevents the biasing member 62 from laterally displacing the button 38 into a locked position. Once in a fully open or closed position, the biasing member 62 laterally displaces the button 38 into a locked position in which a portion of the push button 38 interacts with the tang 70 of the blade to prevent rotation of the blade.

While various embodiments have been described in detail, it is apparent that modifications and alterations of those embodiments will occur to those skilled in the art. For example, embodiments of the locking mechanism disclosed herein can be utilized with any type or form of folding tool or apparatus with a rotatable implement or member. Further, various features of the disclosure have been grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. It is to be expressly understood that such modifications and alterations are within the scope and spirit of the claimed invention, as set forth in the following claims.

What is claimed is:

1. A folding knife comprising:

a handle comprising a first scale, a second scale, and a liner positioned between the first scale and the second scale, the handle having a forward portion;

the handle comprising an aperture extending through the first scale and the second scale;

a blade at least partially disposed between the first scale and the second scale, the blade having a front end and a rear end, the rear end of the blade having a tang rotatably interconnected to the forward portion of the handle; and a blade locking mechanism;

the blade locking mechanism comprising a sidespring and a push button;

the blade locking mechanism extending through the aperture in at least one position of use;

the sidespring comprising an extension of the liner and having a fixed end integrally connected to the liner and a free end that displaces laterally relative to the fixed end; and the push button comprising a receiving hole provided on a circumference of the push button, and wherein the free end of the sidespring is provided in the receiving hole such that the sidespring and the push button are in force transmitting communication and the push button is laterally-displaceable with the sidespring;

wherein the free end of the sidespring is laterally offset from the liner in a non-displaced position;

the push button comprising first and second cylindrical portions and a notch, the notch provided between the first and second cylindrical portions and configured to allow rotation of the blade when the notch is aligned with the tang of the blade; and wherein at least one of the first and second cylindrical portions comprises a ramp portion operable to interact with the tang of the blade to prevent rotation of the blade, and wherein the receiving hole is provided in the ramp portion.

2. The folding knife of claim 1, wherein the push button includes a first end having a recessed portion for indexing with a user's finger.

3. The folding knife of claim 1, wherein at least a portion of the push button extends outwardly from an exterior surface of the handle.

4. The folding knife of claim 1, wherein the forward portion of the handle comprises the aperture.

5. A folding tool with a selective locking mechanism, comprising:

a handle comprising a first handle portion and a second handle portion, the handle having a forward portion and an exterior surface, and wherein an aperture extends through the forward portion of the first handle portion and the second handle portion;

an implement at least partially disposed between the first handle portion and the second handle portion, the implement having a tang rotatably interconnected to the forward portion of the handle; and a biasing member integrally formed in the handle and positioned within the exterior surface of the handle, the biasing member having a first end interconnected to the handle and a second end that displaces laterally relative to the first end of the biasing member;

a button comprising first and second cylindrical portions and a notch, the button extending into the aperture in at least one position of use; and the biasing member provided in force transmitting communication with the button, and wherein the notch is provided between the first and second cylindrical portions and is configured to allow rotation of the implement when the notch is aligned with the tang of the implement; and wherein the button comprises a receiving hole provided on a circumference of the button, and wherein the second end of the biasing member is provided in the receiving hole such that the biasing member and the button are in force transmitting communication and wherein the button and the biasing member are laterally-displaceable; and wherein the button comprises a ramp portion, and wherein the receiving hole is provided in the ramp portion.

6. The folding tool of claim 5, wherein the first handle portion comprises a liner and a scale, and wherein the biasing member is integrally formed in the liner.

7. The folding tool of claim 6, wherein the second end of the biasing member is laterally offset from the liner in a non-displaced position.

8. The folding tool of claim 5, wherein the biasing member comprises an arcuate shape that does not interfere with the rotation of the implement, and wherein the biasing member comprises a linear profile between the first end and the second end.

9. The folding tool of claim 5, wherein the biasing member comprises a length that is less than a length of the handle.

10. The folding tool of claim 5, wherein a sidewall of the button includes the receiving hole, and wherein the second end of the biasing member extends into the receiving hole to couple the button to the biasing member.

11. The folding tool of claim 5, wherein at least a portion of the button extends outwardly from the exterior surface of the handle.

12. The folding tool of claim 5, wherein the implement is a blade.

* * * * *